US005228172A

United States Patent [19]

Gasser et al.

[11] Patent Number: 5,228,172

[45] Date of Patent: Jul. 20, 1993

[54] APPARATUS FOR DEPOSITING A TEXTILE FIBER STRAND

[75] Inventors: Hermann E. Gasser, Frauenfeld; Karl Curiger, Pfaffikon, both of Switzerland

[73] Assignee: Hollingsworth GmbH, Neubulach, Fed. Rep. of Germany

[21] Appl. No.: 623,376

[22] PCT Filed: Mar. 16, 1990

[86] PCT No.: PCT/EP90/00439

§ 371 Date: Dec. 10, 1991

§ 102(e) Date: Dec. 10, 1991

[87] PCT Pub. No.: WO90/11241

PCT Pub. Date: Oct. 4, 1990

[30] Foreign Application Priority Data

Mar. 17, 1989 [DE] Fed. Rep. of Germany ... 8903356[U]

[51] Int. Cl.[5] ..... B65H 54/80

[52] U.S. Cl. ..... 19/159 R

[58] Field of Search ..... 19/157, 159 R, 159 A; 100/82; 242/54.4

[56] References Cited

U.S. PATENT DOCUMENTS

| | | | |
|---|---|---|---|
| 4,041,574 | 8/1977 | Müller | 19/159 R |
| 4,236,278 | 12/1980 | Hoover | 19/159 R |
| 4,372,010 | 2/1983 | Gauvin | 19/159 R |
| 4,809,405 | 3/1989 | Bruderlin et al. | 19/159 R |
| 4,967,449 | 11/1990 | Gasser | 19/159 R |
| 5,111,551 | 5/1992 | Hollingsworth et al. | 19/159 R |

FOREIGN PATENT DOCUMENTS

| | | | |
|---|---|---|---|
| 10002 | 4/1980 | European Pat. Off. | 19/159 R |
| 298519 | 1/1989 | European Pat. Off. . | |
| 1528688 | 10/1978 | United Kingdom | 19/159 R |

*Primary Examiner*—Clifford D. Crowder
*Assistant Examiner*—Michael A. Neas
*Attorney, Agent, or Firm*—Townsend & Townsend Khourie & Crew

[57] ABSTRACT

An apparatus for depositing a textile fiber strand in a spinning can. Mounted in a housing are two rotary plates (4, 5) for rotation about their respective axes, one of the rotary plates being smaller and mounted at an eccentric position inside the outer periphery of the other rotary plate. The rotary plates are connected to a lay-down pipe through which the fiber strand is guided. The two rotary plates are coupled to one another by a revolving belt transmission, the lay-down pipe being composed of a plurality of pipe sections (18, 22, 23, 19, 8) rotatable relative to one another and associated with the rotary plates (4, 5). Disposed adjacent the outlet end of the lay-down pipe is a pneumatic pressure injector (48) for automatically threading the fiber strand.

25 Claims, 4 Drawing Sheets

APPARATUS FOR DEPOSITING A TEXTILE FIBER STRAND

Figure 1:
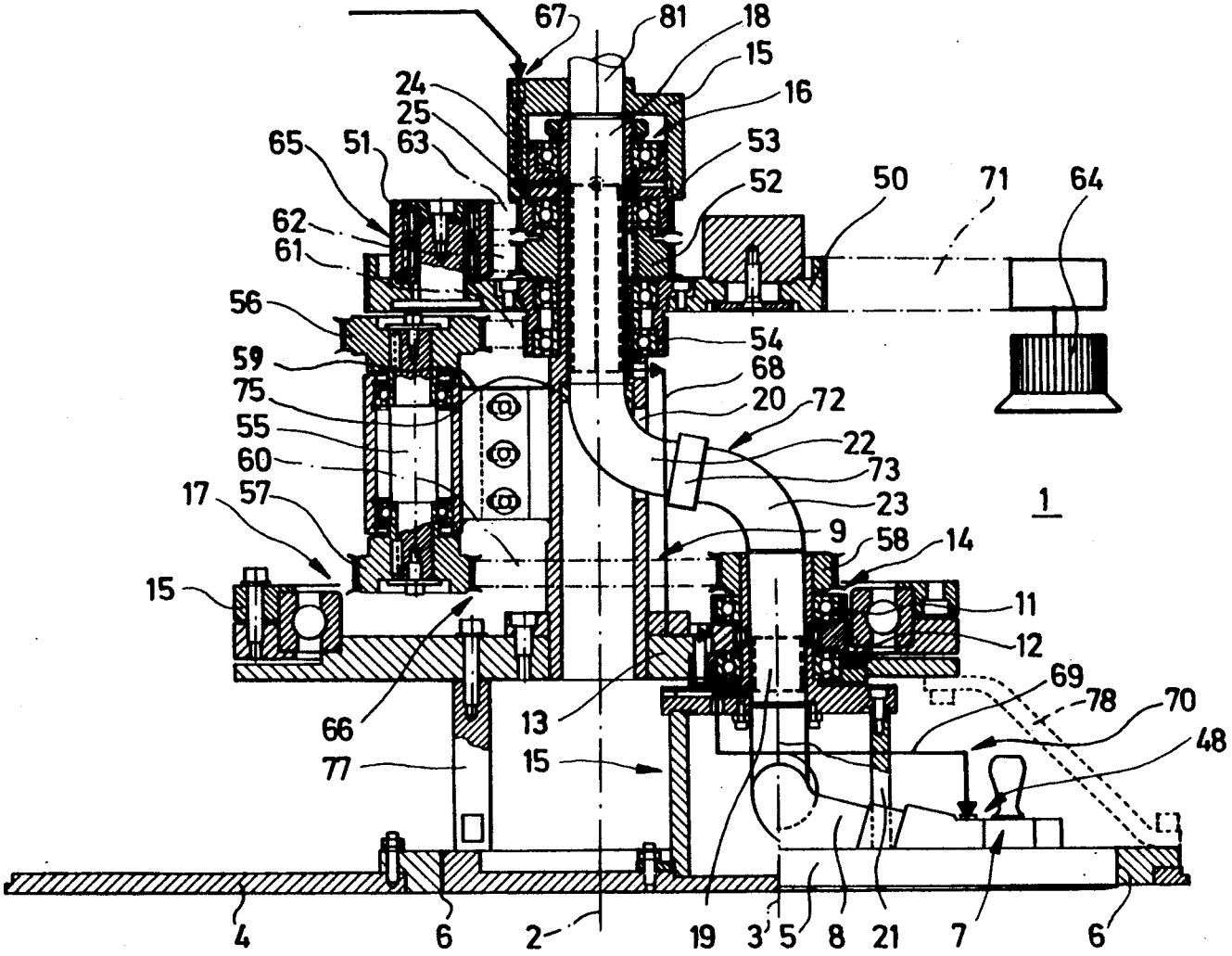

The present invention relates to an apparatus for depositing a fiber strand in a can, comprising a housing and two rotary plates mounted in said housing for rotation about their respective axes, a smaller one of said rotary plates being mounted at an eccentric position internally of the outer periphery of the other, larger rotary plate, and a lay-down pipe having its outlet end connected to said eccentrically mounted rotary plate, whereby said outlet end of said lay-down pipe describes a cycloid path in operation of the apparatus, both of said rotary plates being driven via belt transmissions.

An apparatus according to the features of the generic clause is known from EP-A-O 010 002. The apparatus described in this publication is composed of two side-by-side can mountings including two large rotary plates internally of which smaller rotary plates are rotatably mounted at eccentric positions. For rotating the smaller rotary plates there is provided a belt transmission in a quadrilateral arrangement which is synchronized with a belt transmission for the large rotary plates. To this effect, a driving pulley and a return pulley are mounted at a fixed position outside of the two large rotary plates. The positional variation of the small rotary plates caused by the eccentric displacement thereof requires the provision of two paired can mountings, as this permits the positional variations of the small rotary plates to be compensated.

This arrangement as a whole is rather complicated, particularly as regards the uniformity of the belt tension. Moreover, the known apparatus occupies a relatively large installation volume.

From DE-AS 15 10 339 there is further known a can mounting in which the large rotary plate is provided with external teeth and rotated via a gear transmission. The fiber strand is introduced by a feed roller pair into a fiber strand passage provided in the smaller rotary plate, with the feed roller pair performing a rotary movement corresponding to that of the large rotary plate. This construction, too, results in a rather bulky can mounting extending far beyond the outer periphery of the spinning can.

It is therefore the object of the present invention to provide a can mounting of compact construction.

To attain this object, the invention provides that the two rotary plates are coupled via at least one revolving belt transmission, that the lay-down pipe is composed of a plurality of pipe sections associated with the rotary plates and rotatable relative to one another, and that a pneumatic pressure injector is provided at least at the outlet end of the lay-down pipe for the automatic threading of the fiber strand.

The coupling of the two rotary plates via at least one revolving belt transmission has the effect that the belt transmissions are located within the base area of the large rotary plate, and that the belt tension is always maintained constant, so that no particular devices are required for this purpose. The belts of the revolving belt transmission extend around the lay-down pipe, the belt driving the small rotary plate revolving clockwise about the lay-down pipe section located in the axis of the large rotary plate. This results in a very compact construction. An important role is played in this context by the pneumatic pressure injector provided for automatically threading or feeding the fiber strand, the combination of the automatic fiber strand feeding operation with the revolving belt transmission permitting the periphery of the can mounting to be reduced to that of the large rotary plate.

Although the use of a pneumatic pressure injector for the automatic threading or feeding of the fiber strand is known from DE-OS 37 22 772, rotation of the rotary plates is brought about in the conventional manner, which does not permit a compact construction of the apparatus.

An advantageous aspect of the invention results from the provision that the pneumatic pressure injector is connected to a pneumatic pressure line through two rotary couplings associated with the rotary axes of the rotary plates. This permits the pneumatic pressure line to be installed in a very simple manner.

A particularly compact construction of the can mounting results from the provision that a short guide sleeve and a long guide sleeve are secured to the small rotary plate and the large rotary plate, respectively, at coaxial positions, each guide sleeve containing a respective lay-down pipe section disposed therein. This permits two functional units, namely, the rotation of the rotary plate and the feeding of the fiber strand, to be advantageously combined in a single structural unit.

A simplified and readily serviceable construction is obtained when the short guide sleeve is rotatably mounted by means of a radial bearing in a mounting support secured to the long guide sleeve.

Advantageously the long guide sleeve is rotatably mounted by means of a radial bearing supported by the housing, this arrangement permitting the long guide sleeve to be held in place while at the same time establishing a fixed reference location for the revolving belt transmission. The housing is additionally effective to protect the can mounting from ambient influences.

The loads acting on the mounting of the long guide sleeve may be reduced in an advantageous manner when the mounting support is also mounted in the housing for rotation about the axis of the large rotary plate.

For achieving a particularly space-saving construction, the present invention provides that the radial bearings of the guide sleeves connected to the rotary plates are disposed in the rotary couplings. In this manner the mounting of the rotary plates and the pneumatic pressure lines are combined in a single structural component.

A particularly advantageous space-saving effect is obtained when belt pulleys of the revolving belt transmission are secured to the outer surface of the guide sleeve.

A further advantage is obtained by the provision that one belt pulley is rotatably mounted on the long guide sleeve and adapted to be connected to a belt through a belt to thereby act as a driving pulley. This permits the large rotary plate to rotate at a lower speed than the driving pulley, so that it is possible to employ a smaller and more space-saving driving pulley in combination with a low-cost electric motor.

The reduction of the rotary speed is accomplished in a simple manner by a revolving belt transmission mounted on the long guide sleeve and eccentrically connected to the driving pulley.

In this context a particularly advantageous construction provides that one belt pulley of the first revolving belt transmission is non-rotatably mounted on the long guide sleeve, while another belt pulley is fixedly connected to the housing and rotatably mounted on the long guide sleeve, the belt pulleys being of slightly different diameters and connected by belts to a common belt pulley rotatably mounted on the driving pulley at an eccentric position. In this manner it is possible to obtain a space-saving construction of the speed-reducing belt transmission permitting a great speed difference to be established between the large rotary plate and the driving pulley.

The use of a second revolving belt transmission permits the driving pulley and the short guide sleeve to be connected to each other in a simple manner.

Any possibly existing height difference may be bridged in an advantageous manner by a transmission shaft rotatably mounted on the long guide sleeve at an eccentric position and carrying two belt pulleys secured thereto.

When the short guide sleeve and the driving pulley of the long guide sleeve carry a respective belt pulley non-rotatably secured thereto at coaxial positions and connected via respective belts to the belt pulleys of the transmission shaft, the speed-reducing revolving belt transmission for coupling the small rotary plate to the driving pulley can be implemented in a structurally simple manner.

The rotatable coupling may be manufactured in a particularly simple manner when it is composed of two coaxially aligned rotary members mounted by radial bearings for rotation relative to one another and enclosing therebetween an annular space connected to the pneumatic pressure line through connections in the rotary members. In this manner it is possible for a pressurized gas to pass through the annular space defined by the rotary members.

In this context a particularly simple construction is obtained when the inner rotary member is formed of two axially offset annular sleeves disposed between the radial bearings and acting as axial boundaries of the annular space. This permits the pressurized gas to uniformly expand in the radial direction.

In another context it is of advantage for the construction of the pneumatic pressure line when the circumferential wall of each of the long and short guide sleeves is formed with at least one radial through-bore opening into the annular space of the respective rotary coupling, and at an axially spaced location therefrom, with a further through-bore for connection to the pneumatic pressure line, the inner diameter of the guide sleeves between these bores being greater than the outer diameter of the respective lay-down pipe section, so that an annular passage communicating with the two through-bores is defined between each guide sleeve and the associated lay-down pipe section. As a result of this ingenious arrangement, the guide sleeve cooperates with the lay-down pipe section in a double function to form a section of the pneumatic pressure line.

When the outer rotary member of the rotary coupling of the long guide sleeve is fixedly connected to the housing, it is possible to achieve a readily serviceable construction, in which the pneumatic pressure connection may be established via the outer housing side.

When the pneumatic pressure line is composed of individual sections extending respectively from the through-bore of the long guide sleeve to the rotary coupling of the short guide sleeve, and from the through-bore of the short guide sleeve to the pneumatic pressure injector, the individual sections of the pneumatic pressure line can be connected to the guide sleeves in a particularly simple manner.

In order to permit the lay-down pipes of the long and the short guide sleeves to be connected in a simple manner, the latter may be formed with a recess below the respective lay-down pipe section for the passage therethrough of the lay-down pipe from the interior of the respective guide sleeve.

In a particularly simple construction, the lay-down pipe sections in the long and the short guide sleeves may be interconnected by a lay-down pipe section extending through the recess of the long guide sleeve.

The assembly can be accomplished in a very simple manner when the interconnecting lay-down pipe section is of S-shaped configuration.

When the interconnecting lay-down pipe section is composed of two arcuate lay-down pipe sections adapted to be connected to one another by a sleeve nut, it is possible to readily gain access to the lay-down pipe sections within the guide sleeves.

The simple construction of the short guide sleeve permits the lay-down pipe section of the short guide sleeve and the outlet end on the eccentrically mounted rotary plate to be interconnected by a lay-down pipe section extending through the recess of the short guide sleeve.

The provision adjacent the outlet end of the lay-down pipe of a fiber strand presser member directed onto the rim of a recess formed in the large rotary plate and enclosing the small rotary plate permits the fiber strand to be guided in a particularly advantageous manner between the rims of the large and the small rotary plates, to which purpose the friction coefficient of the rim of the recess is selected to be greater than the friction coefficient of the presser member. This advantageous design ensures the automatic removal of the fiber strand during rotation of the rotary plate.

The compression of the fiber strand is especially promoted in an advantageous manner when a nozzle member is disposed between the pneumatic pressure injector and the presser member to reduce the internal cross-sectional area of the lay-down pipe in the direction towards the outlet end.

Figure 2:
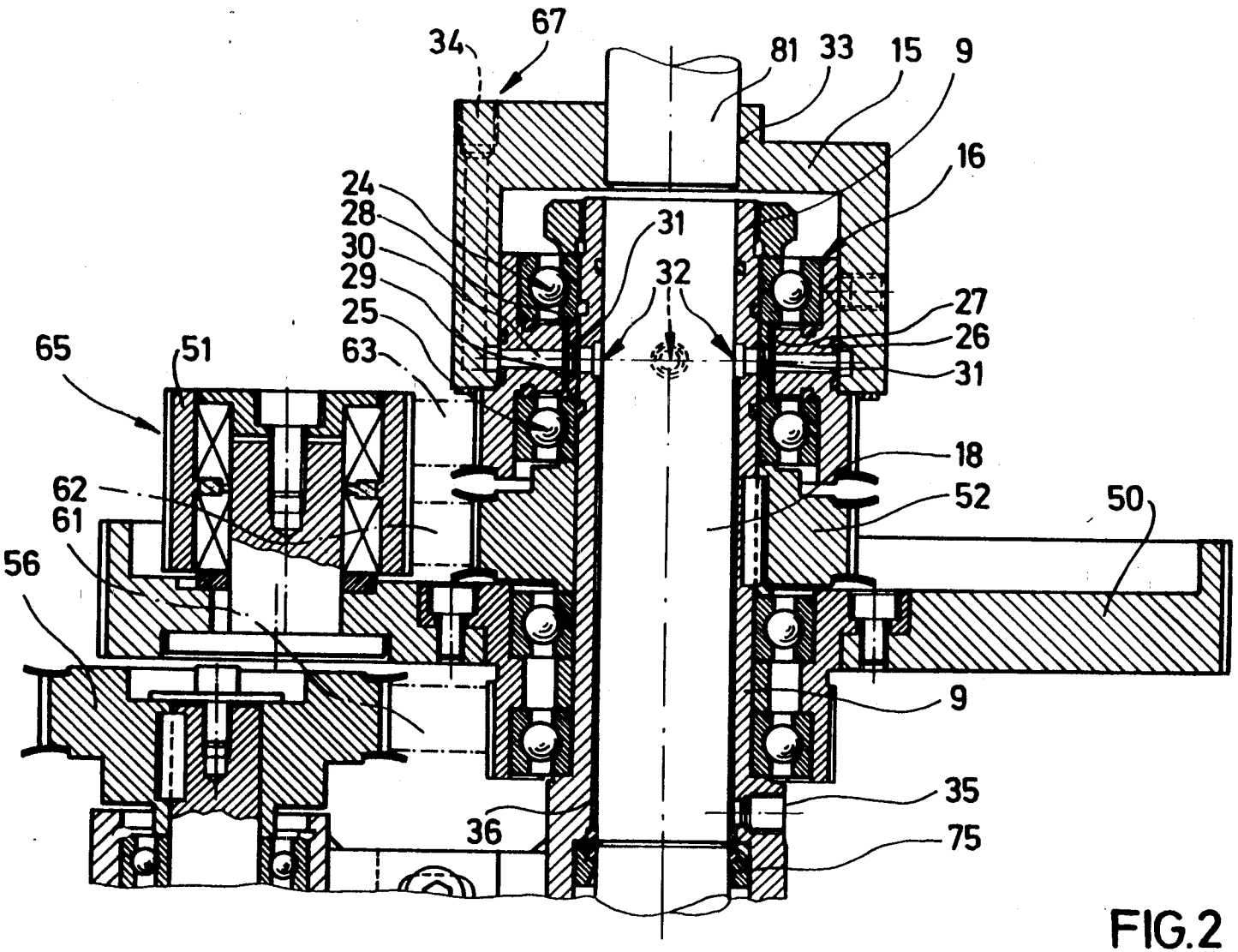
Figure 3:
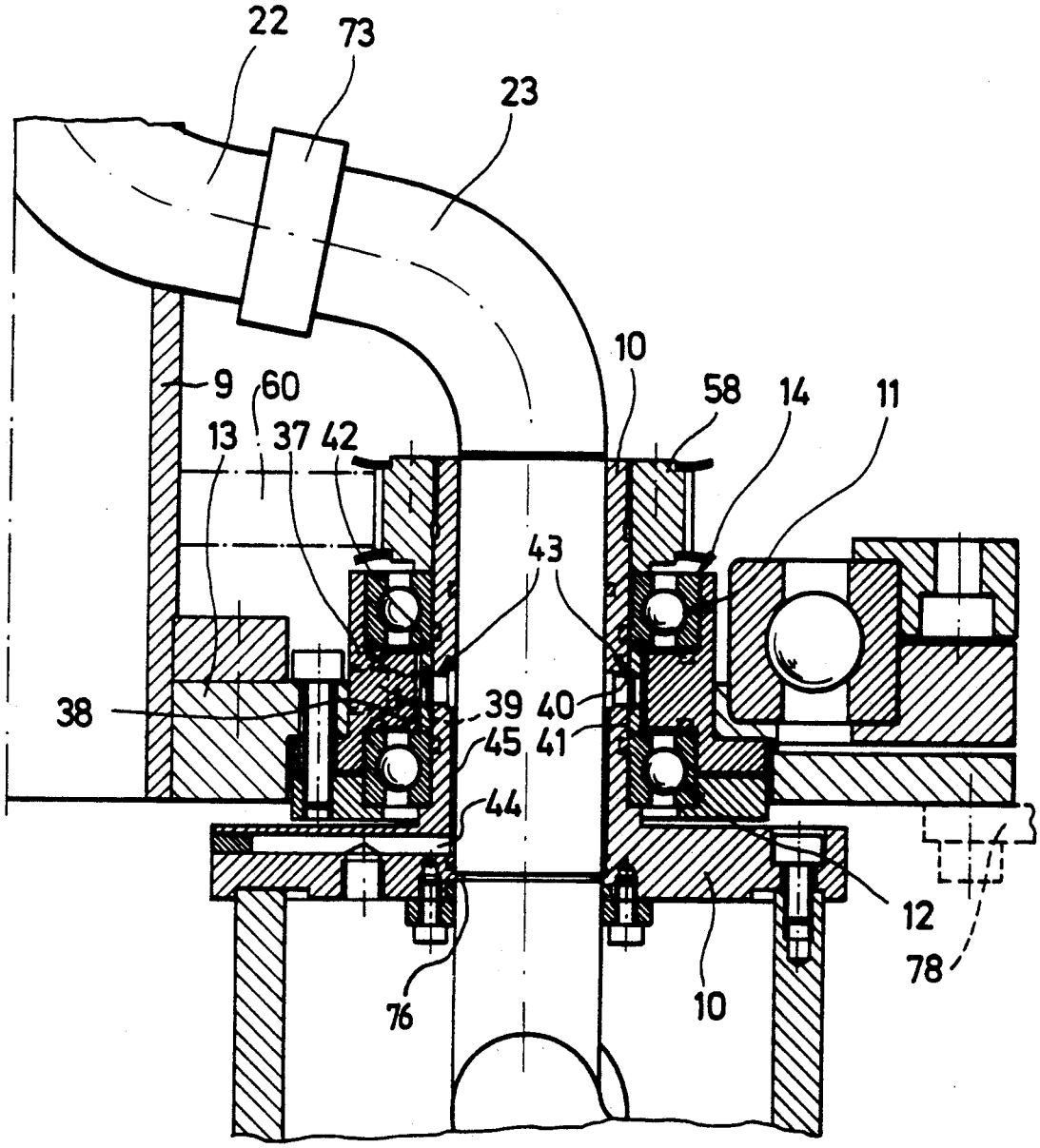
Figure 4:
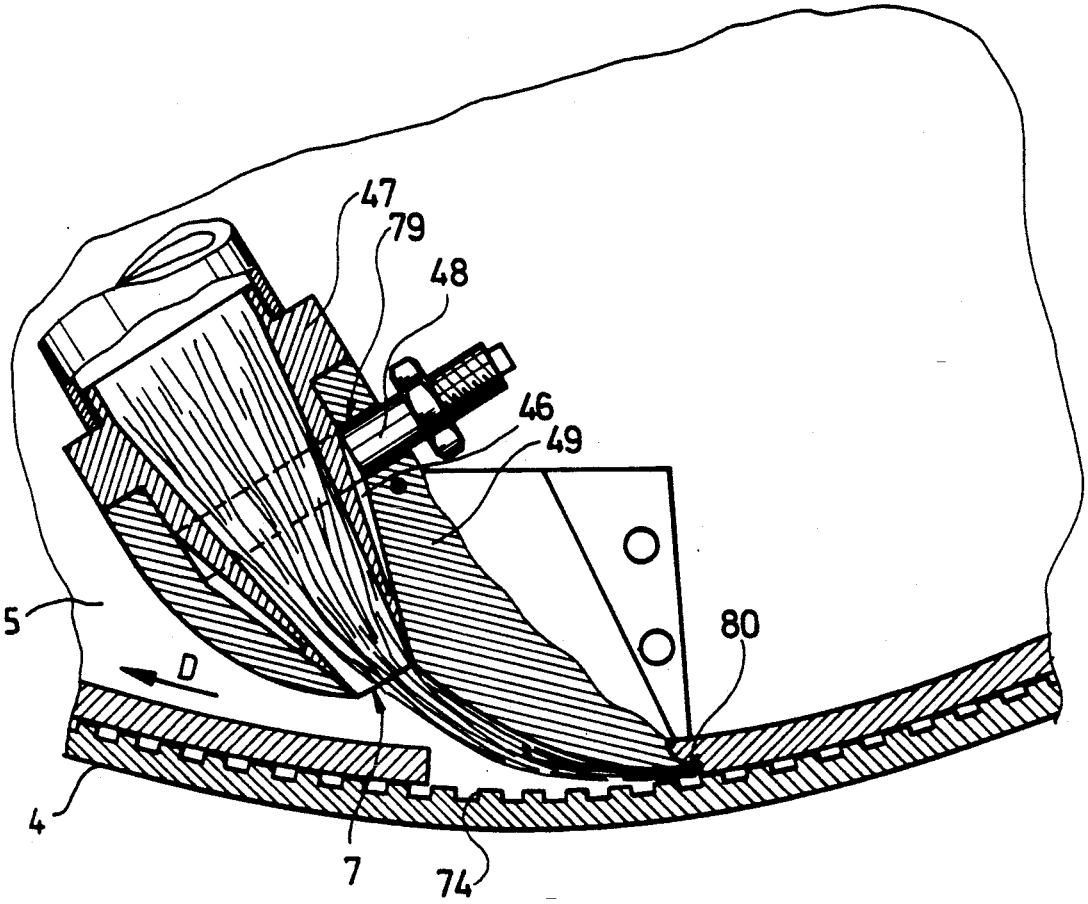

An embodiment of the invention shall now be explained in more detail with reference to some drawings, wherein:

FIG. 1 shows a longitudinally sectioned view of an apparatus for depositing a fiber strand, FIG. 2 shows an enlarged detail of a longitudinally sectioned view of a rotary coupling provided on a long guide sleeve, FIG. 3 shows an enlarged detail of a longitudinally sectioned view of a rotary coupling provided on a short guide sleeve, and FIG. 4 shows an outlet end provided on a small rotary plate.

Shown in FIG. 1 is an apparatus 1 for depositing a fiber strand, in which two rotary plates 4, 5 are mounted for rotation about their respective axes 2, 3. In this arrangement, a small rotary plate 5 is disposed at an eccentric position within the outer periphery 6 of a large rotary plate 4. Large rotary plate 4 is secured to a long guide sleeve 9, and small rotary plate 5 to a short guide sleeve 10, with the short guide sleeve 10 being rotatably mounted by means of a rotary coupling 14 secured in a mounting support 13. Mounting support 13 on its part is secured to long guide sleeve 9, which is rotatably mounted by means of a rotary coupling 16 arranged on a stationary housing 15. In addition to the mounting of long 9 and short 10 guide sleeves, rotary couplings 14 and 16 perform the function of ensuring the supply of pressurized gas to a pneumatic pressure injector 48 in cooperation with a pneumatic pressure supply connector 67 and pneumatic pressure line sections 68 and 69. In order to reduce the loads acting on rotary coupling 16 on long guide sleeve 9, the mounting support 13 connected to long guide sleeve 9 is in addition rotatably mounted by a radial bearing 17 supported by housing 15. For the fiber strand feeding operation, each of long and short guide sleeves 9, 10 contains a lay-down pipe section 18 and 19, respectively, disposed therein, and at a location below lay-down pipe sections 18 and 19, respectively, long and short guide sleeves 9, 10 are each provided with a recess 20, 21 for the passage therethrough of the lay-down pipe from the interior of the guide sleeves 9, 10. An S-shaped lay-down pipe section 72 is employed for interconnecting lay-down pipe section 18 disposed in long guide sleeve 9 and lay-down pipe section 19 disposed in short guide sleeve 10. Lay-down pipe section 19 in short guide sleeve 10 is connected to an outlet end 7 provided on small rotary plate 5 via a lay-down pipe section 8 passing through recess 21 of short guide sleeve 10. Disposed at the first side of long guide sleeve 9 is a first speed-reducing revolving belt transmission 65 cooperating with an electric motor 64 for driving large rotary plate 4. A second speed-reducing revolving belt transmission 66 likewise disposed on the outer side of long guide sleeve 9 is provided for rotating small rotary plate 5. The employed speed-reducing revolving belt transmissions 65 and 66 employ toothed belts and toothed belt pulleys instead of belts and belt pulleys.

As furthermore illustrated in FIG. 1, long guide sleeve 9 carries an enlarged guide sleeve 77 disposed below mounting support 13, and a support bracket 78 connected to mounting support 13 and large rotary plate 4. This is effective to improve the stability of the long guide sleeve, in view of the fact that the axis of symmetry 2 of large rotary plate 4 passe through small rotary plate 5.

S-shaped lay-down pipe section 72 is composed of two arcuate lay-down pipe sections 22 and 23 adapted to be interconnected by a sleeve nut 73. It is also possible, however, to replace sleeve nut 73 by any other connection means at the disposal of those skilled in the art. In view of the fact that only the upper arcuate lay-down pipe section 22 is secured in place by a retainer bushing 75 disposed on long guide sleeve 9, loosening of sleeve nut 73 permits lower arcuate lay-down pipe section 23 to be removed entirely to thereby gain free access to lay-down pipe sections 18 and 19, respectively.

FIG. 2 illustrates an enlarged detail of the longitudinally sectioned view of the rotary coupling 16 mounted rotatably on long guide sleeve 9. Rotary coupling 16 is composed of an outer rotary member 26 and an inner rotary member 27 mounted by radial bearings 24 and 25 for rotation relative to one another. Radial bearings 24 and 25 and inner rotary member 27 are secured to the outer surface of long guide sleeve 9. Outer rotary member 26 is formed with a through-bore 30 for connection to the pressurized gas supply line, while inner rotary member 27 is composed of two axially offset annular bushings 28 and 29, so that the pressurized gas can pass through bore 30 into an annular space 31 enclosed between the two annular bushings 28 and 29. To seal the above-mentioned annular space 31, outer rotary member 26 and inner rotary member 27 are sealed with respect to radial bearings 24 and 25. The circumferential wall of long guide sleeve 9 is formed with four radially distributed through-bores 32 opening into annular space 31 of rotary coupling 16. Axially spaced therefrom, the circumferential wall of long guide sleeve 9 is formed with a further through-bore 35 for the connection thereto of pneumatic pressure line section 68. Between these through-bores 32 and 35, the inner diameter of long guide sleeve 9 is greater than the outer diameter of lay-down pipe section 18, so as to define therebetween an annular passage 36 communicating with through-bores 32 and 35. A retainer bushing 75 installed within long guide sleeve 9 below lay-down pipe section 18 serves on the one hand to secure arcuate lay-down pipe section 22 in place, and on the other hand, to act as the lower boundary of annular passage 36 between lay-down pipe section 18 and the enlarged inner diameter of long guide sleeve 9.

FIG. 3 depicts an enlarged detail of the longitudinally sectioned view of the rotary coupling 14 mounted rotatably on short guide sleeve 10. Rotary coupling 14 is composed of an outer rotary member 37 and an inner rotary member 38 mounted by means of radial bearings 11 and 12 for rotation relative to one another. Radial bearings 11 and 12 and inner rotary member 38 are secured to the outer surface of short guide sleeve 10. Outer rotary member 37 is formed with a through-bore 39 for the connection of the pneumatic pressure line, while inner rotary member 38 is composed of two axially offset annular bushings 40 and 41, so that the pressurized gas can pass through bore 39 into the annular space 42 enclosed between the two annular bushings 40 and 41. For sealing the above-mentioned annular space 42, outer rotary member 37 and inner rotary member 38 are sealed with respect to radial bearings 11 and 12. The circumferential wall of short guide sleeve 10 is formed with two radially distributed through-bores 43 opening into annular space 42 of rotary coupling 14. Axially spaced therefrom, the circumferential wall of short guide sleeve 10 is formed with a further through-bore 44 for the connection of pneumatic pressure line section 69. Between these through-bores 43 and 44, the inner diameter of short guide sleeve 10 is greater than the outer diameter of lay-down pipe section 19, so as to define therebetween an annular passage 45 communicating with through-bores 43 and 44. For the downward boundary of the annular passage 36 formed between lay-down pipe section 19 and the enlarged inner diameter of short guide sleeve 19, short guide sleeve 10 comprises an aperture-like stop 76 disposed between lay-down pipe section 19 and lay-down pipe section 8. Outer rotary member 37 of rotary coupling 14 is secured to mounting support 13 of large guide sleeve 9.

As illustrated in FIG. 2, outer rotary member 26 is partly surrounded by a housing portion 15 formed with two bores 33 and 34, of which bore 34 opens into through-bore 30 for the pneumatic pressure supply connection, while bore 33 contains a fiber strand inlet pipe inserted therein in alignment with lay-down pipe section 18.

FIG. 4 depicts the outlet end on the small rotary plate. Disposed between lay-down pipe section 8 and outlet end 7 is a nozzle 47 converging towards outlet end 7, noozle 47 being laterally enclosed by a presser member 49 so as to define a cavity 46 therebetween. Cavity 46 defined between nozzle 47 and presser member 49 communicates with a pneumatic pressure injector 48 by means of a through-bore 79 in pressing member 49. At outlet end 7 presser member 49 extends in alignment with nozzle 47 towards the outer periphery of small rotary plate 80, the friction coefficient of presser member 49 being of a smaller value than the friction coefficient on the rim of large rotary plate 74, which is provided with recesses. For the supply of pressurized gas to pneumatic pressure injector 48, a pneumatic pressure line section 68 is connected to through-bore 35 in the circumferential wall of long guide sleeve 9 and to through-bore 39 of outer rotary member 37 of rotary coupling 14 rotatably mounted on short guide sleeve 10. For the further conveyance of the pressurized gas, a second pneumatic pressure line section 69 is connected to through-bore 44 of short guide sleeve 10 and to the inlet port of pneumatic pressure injector 48.

Also shown in FIG. 1 is the arrangement of revolving belt transmissions 65 and 66. Mounted on the outer surface of long guide sleeve 9 is a rotatably supported driving pulley 50 which is connected to an electric motor 64 by a toothed belt 71. Above driving pulley 50, a toothed belt pulley 52 is non-rotatably secured to long guide sleeve 9, and toothed belt pulley 53 is non-rotatably secured to outer rotary member 26 of rotary coupling 16. The two toothed belt pulleys 52 and 53 are of different diameter. Driving pulley 50 carries a toothed belt pulley 51 rotatably mounted thereon at an eccentric position radially spaced from toothed belt pulleys 52 and 53. A toothed belt pulley 54 disposed below driving pulley 50 is non-rotatably connected to driving pulley 50. Long guide sleeve 9 additionally carries a mounting support 59 which cam be adjusted by means of screws and in which a transmission shaft 55 is rotatably mounted, with two non-rotatable toothed belt pulleys 56 and 57 being secured to transmission shaft 55. For driving small rotary plate 5, a toothed belt pulley 58 is non-rotatably secured to the outer surface of short guide sleeve 10, with toothed belt pulley 58 being connected to toothed belt pulley 57 of transmission shaft 55 by a toothed belt 60. Toothed belt 61 connects toothed belt pulley 56 of transmission shaft 55 to toothed belt pulley 54 connected to driving pulley 50. For driving large rotary plate 4, the toothed belt pulley 51 eccentrically mounted on driving pulley 50 is coupled to toothed belt pulleys 52 and 53 by two toothed belts 62 and 63.

The function of the apparatus in operation shall now be described as follows: When electric motor 64 is switched on, small rotary plate 5 and large rotary plate 4 are rotated via toothed belt pulley 71 and the two speed-reducing revolving belt transmissions 66 and 65. The leading end of a fiber strand to be fed is then positioned adjacent the upper end of the lay-down pipe connection. For feeding the fiber strand, the pressurized-gas supply to pneumatic pressure injector 48 is then activated, whereby the pressurized gas enters annular space 31 of rotary coupling 16 through pressure supply inlet port 34, and from there flows into annular passage 36 in long guide sleeve 9. From there the gas enters annular space 42 of rotary coupling 14 through pneumatic pressure line section 68 connected to through-bore 35, to subsequently flow into annular passage 45 of short guide sleeve 10. The pressurized gas then flows to the pressure inlet port of pneumatic pressure injector 48 through pneumatic pressure line section 69 connected to through-bore 44, to generate a conveying gas flow in the lay-down pipe. As a result, the fiber strand is entrained from lay-down pipe inlet section 81 through lay-down pipe section 18 in long guide sleeve 9 and through the connecting section 72 composed of two arcuate lay-down pipe sections 22 and 23, into lay-down pipe section 19 in short guide sleeve 10, from where it is sucked into conically converging nozzle 47 through lay-down pipe section 8. From there it proceeds along presser member 49 towards the outer rim 74 of large rotary plate 4. At this time the supply of pressurized gas is interrupted. Small rotary plate 5 is rotated in direction D, so that the fiber strand is held in engagement with the outer rim of large rotary plate 74 and pulled out of outlet end 7 by the rotation of small rotary plate 5. Small rotary plate 5 is driven via toothed belt pulley 54 fixedly connected to driving pulley 50 and connected by toothed belt 61 to toothed belt pulley 56 secured to transmission shaft 55. As a result, the driving force is transmitted to toothed belt 60 which is connected to toothed belt pulley 57 and also to toothed belt pulley 58 secured to short guide sleeve 10. As a consequence, small rotary plate 5 is driven by toothed belt pulleys 58, 57, 56 and 54 and by driving pulley 50 which is connected to electric motor 64 by a toothed belt 71, and toothed belts 60 and 61. Large rotary plate 4 is driven via the toothed belt pulley 51 which is eccentrically and rotatably mounted on driving pulley 50 and rotates eccentrically about long guide sleeve 9 with driving pulley 50. Since toothed belt pulley 51 is connected by a toothed belt 63 to the toothed belt pulley 53 seated on outer rotary member 26 of rotary coupling 16, itself fixedly secured to housing 15, the rotation of driving pulley 50 causes toothed belt pulley 51 to be rotated by its engagement with toothed belt 63, whereby said pulley rotates. At the same time, toothed belt pulley 51 is connected by a second toothed belt 62 to the toothed belt pulley 52 mounted on long guide sleeve 9. If the diameter of toothed belt pulley 52 were the same as that of toothed belt pulley 53, the large rotary plate would not rotate. However, thanks to the use of a toothed belt pulley 52 having a diameter different from that of toothed belt pulley 53, a rotation of large rotary plate 4 is achieved, the speed thereof being dependent on the difference in diameter of the two toothed belt pulleys 52 and 53. Since in the present example large rotary plate 4 is required to rotate at small speed, the difference between the two toothed belt pulleys 52 and 53 is only one tooth. The direction of rotation of the large rotary plate is determined by whether toothed belt pulley 52 is greater or smaller than toothed belt pulley 53, it being possible in this manner to determine whether the large and small rotary plates are rotated in the same direction or in opposite directions.

We claim:

1. An apparatus for depositing a textile fiber strand in a can, said apparatus comprising:

a housing;

a large rotary plate rotatably mounted in the housing about a first axis;

a drive for rotating the large rotary plate;

a first pulley operatively coupled to the drive and the large rotary plate, the first pulley being coaxial with the large rotary plate;

a small rotary plate having a diameter less than that of said large rotary pulley and being rotatably mounted within the outer circumference of the large rotary plate about a second axis;

a second pulley positioned coaxial with the second rotary plate, the second rotary plate being coupled to the second pulley for co-rotation therewith;

a lay-down pipe subdivided with into pipe sections that are associated with the large and small rotary plates and rotatable relative to one another, the lay-down pipe having an outlet end coupled to the small rotary plate, the outlet end of the lay-down pipe describing a cycloid path in operation of the apparatus;

a pressure gas injector disposed in the vicinity of the outlet end of the lay-down pipe for automatically drawing a fiber strand through the lay-down pipe; and a first revolving belt transmission that couples the large and small rotary plates, the first and second pulleys forming a portion of the revolving belt transmission which further includes:

a third and fourth pulley;

a transmission shaft having a longitudinal axis spaced from the first axis and rotatably mounted about the first axis, the third and fourth pulleys being mounted on the transmission shaft for co-rotation therewith;

a first belt coupling the first pulley to the third pulley; and a second belt coupling the second pulley, which is associated with the small rotary plate, to the fourth pulley.

2. Apparatus according to claim 1, further including first and second rotary couplings and a pneumatic pressure line, said pressure gas injector being connected to said pneumatic pressure line through said rotary couplings, each one of the rotary couplings being mounted about one of the first and second axes of said rotary plates.

3. Apparatus according to claim 1, wherein a short guide sleeve and a long guide sleeve are secured to said small rotary plate and said large rotary plate, respectively, said long guide sleeve being coaxial with said large rotary plate and said short guide sleeve being coaxial with said short rotary plate, each of said guide sleeves has disposed therein one of said lay-down pipe sections.

4. Apparatus according to claim 3, wherein said long guide sleeve is rotatably mounted by means of a first radial bearing that is supported by said housing.

5. Apparatus according to claim 4, wherein said short guide sleeve is rotatably mounted by means of a second radial bearing that is mounted in a mounting support, said mounting support being secured to said long guide sleeve.

6. Apparatus according to claim 5, wherein said mounting support is rotatably mounted in said housing for rotation about said first axis.

7. Apparatus according to claim 5, including a pair of rotary couplings and a pneumatic pressure line, said pressure gas injector being connected to said pneumatic pressure line through said pair of rotary couplings, said first and second radial bearings being disposed in said rotary couplings.

8. Apparatus according to claim 3, wherein said first pulley is secured to the outer surface of said long guide sleeve and said second pulley is secured to the outer surface of said short guide sleeve.

9. Apparatus according to claim 3, wherein said drive is a driving pulley that is rotatably mounted on said long guide sleeve and adapted to be driven by a belt.

10. Apparatus according to claim 9, including a second revolving belt transmission, said second revolving belt transmission being mounted on said long guide sleeve and eccentrically connected to said driving pulley.

11. Apparatus according to claim 10, wherein said second revolving belt transmission includes a fifth, sixth and seventh belt pulley, and a third and fourth belt, said fifth belt pulley being non-rotatably mounted on said long guide sleeve, said sixth belt pulley being fixedly connected to the housing and rotatably mounted on said long guide sleeve, said seventh belt pulley being rotatably mounted on said driving pulley at an eccentric position, said fifth and sixth belt pulleys being of slightly different diameters and connected by said third and fourth belts to said seventh belt pulley.

12. Apparatus according to claim 9, wherein said driving pulley and said short guide sleeve are interconnected by said first revolving belt transmission.

13. Apparatus according to claim 9, wherein said second pulley is non-rotatably secured to said short guide sleeve and said first pulley is non-rotatably secured to said driving pulley.

14. Apparatus according to claim 2, wherein each rotary coupling includes a pair of coaxially aligned rotary members that are mounted by radial bearings for rotation relative to one another, each rotary member pair enclosing therebetween an annular space that is connected to said pneumatic pressure line through connections in said rotary members.

15. Apparatus according to claim 14, wherein each rotary member pair includes an inner rotary member and an outer rotary member, said inner rotary member having two axially offset annular sleeves that are disposed between the radial bearings of the respective rotary member and act as axial boundaries of said annular space.

16. Apparatus according to claim 15, wherein a short guide sleeve and a long guide sleeve are secured to said small rotary plate and said large rotary plate, respectively, each guide sleeve having a circumferential wall, said long guide sleeve being coaxial with said large rotary plate and said short guide sleeve being coaxial with said short rotary plate, each of said guide sleeves containing a section of said lay-down pipe, the circumferential wall of each of said long and short guide sleeves is formed with a first radial through-bore, which opens into one of said annular spaces of the corresponding rotary coupling, and a second through-bore, which is axially spaced from said first through-bore, for connection to said pneumatic pressure line, the inner diameter of each guide sleeve between a respective first and second through-bore pair being greater than the outer diameter of the respective lay-down pipe section such that an annular passage communicating with a respective first and second through-bore pair is defined between the respective guide sleeve and the associated lay-down pipe section.

17. Apparatus according to claim 16, wherein each rotary member of the rotary coupling of said long guide sleeve is fixedly connected to said housing.

18. Apparatus according to claim 17, wherein said pneumatic pressure line includes individual sections, a first one of said pressure line section extending from said second through-bore of said long guide sleeve to said rotary coupling of said short guide sleeve, a second one of said pressure line sections extending from said second through-bore of said short guide sleeve to said pneumatic pressure injection.

19. Apparatus according to claim 3, wherein each of said short and long guide sleeves is formed with a recess for the passage therethrough of the lay-down pipe from the interior of the respective guide sleeve.

20. Apparatus according to claim 19, wherein said lay-down pipe sections disposed in said long and in said short guide sleeve are interconnected by one of said lay-down pipe sections that extends through said recess in said long guide sleeve.

21. Apparatus according to claim 20, wherein said interconnecting lay-down pipe section has an S-shaped configuration.

22. Apparatus according to claim 21, wherein said interconnecting lay-down pipe section includes two arcuate lay-down pipe sections adapted to be connected to one another by a sleeve nut.

23. Apparatus according to claim 22, wherein said lay-down pipe section disposed in said short guide sleeve and said lay-down pipe outlet end coupled to said small rotary plate are interconnected by another one of said lay-down pipe in said short guide sleeve (10).

24. Apparatus according to claim 1, including a fiber strand presser member disposed adjacent the outlet end of said lay-down pipe, said large rotary plate including a rim having a recess formed therein, wherein said presser member is directed onto the rim of the recess formed in said larger rotary plate and encloses said small rotary plate, the friction coefficient of said rim of said recess being selected to be greater than the friction coefficient of said presser member.

25. Apparatus according to claim 24, including a nozzle member disposed between said pressure gas injector and said presser member to reduce the internal cross-sectional area of said lay-down pipe in a direction towards said outlet end.

* * * * *